US011209255B1

(12) United States Patent
Sequeira et al.

(10) Patent No.: US 11,209,255 B1
(45) Date of Patent: Dec. 28, 2021

(54) PRESS LOAD PROCESS FOR WARHEADS

(71) Applicant: U.S. Government as Represented by the Secretary of the Army, Dover, NJ (US)

(72) Inventors: John Sequeira, Jersey City, NJ (US); Sean Swaszek, Denville, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/010,933

(22) Filed: Sep. 3, 2020

Related U.S. Application Data

(60) Provisional application No. 62/898,068, filed on Sep. 10, 2019.

(51) Int. Cl.

| | |
|---|---|
| ***F42B 33/02*** | (2006.01) |
| *F42B 33/00* | (2006.01) |
| *B65B 3/34* | (2006.01) |

(52) U.S. Cl.
CPC ..... *F42B 33/0257* (2013.01); *F42B 33/02* (2013.01); *F42B 33/0285* (2013.01); *B65B 3/34* (2013.01); *F42B 33/001* (2013.01)

(58) Field of Classification Search
CPC ... F42B 33/02; F42B 33/0285; F42B 33/0257
See application file for complete search history.

(56) References Cited

U.S. PATENT DOCUMENTS 2,283,230 A * 5/1942 Rogers ..... F42B 33/0285 222/131
2,405,507 A * 8/1946 Lefren ..... F42B 33/0292 222/137
2,807,975 A * 10/1957 Bohlman ..... F42B 33/0257 86/20.13
3,077,834 A * 2/1963 Caldwell ..... F42B 1/032 102/306
3,091,368 A * 5/1963 Harley ..... G01F 11/24 222/56
3,266,531 A * 8/1966 Mccown, Jr. ..... F42B 33/02 141/1
3,828,984 A * 8/1974 Gmuer ..... B65D 88/66 222/196
3,924,510 A 12/1975 Strunk
3,956,452 A * 5/1976 Saito ..... B28B 3/003 264/500
3,961,554 A 6/1976 Harris
3,968,724 A * 7/1976 Kowalick ..... C06B 21/0041 86/20.1

(Continued)

*Primary Examiner* — Derrick R Morgan
(74) *Attorney, Agent, or Firm* — John P. DiScala

(57) ABSTRACT

An improved process provides high-density pre-form billets that meet dimensional limitations required for case-load tooling. Previous isostatic fill procedures were improved in two ways to accommodate varying bulk densities or powder compositions. First, during the isostatic fill procedure, the powder fill is subject to both a high frequency vibration and a high amplitude, low frequency impulse. The combination of these two inputs is critical to ensure polymer bonded explosives pack to consistent densities. Second, unlike in conventional practices, the fill rate is kept constant throughout the entire fill process and the mold is completely filled by the time the required powder mass has been dispensed.

8 Claims, 3 Drawing Sheets

(56) References Cited

U.S. PATENT DOCUMENTS 4,000,235 A * 12/1976 Van Leemput ..... B22F 3/04 264/109
4,020,736 A * 5/1977 Petersen ..... F42B 33/025 86/20.12
4,208,945 A * 6/1980 Davegardh ..... F42B 33/025 86/20.11
4,250,792 A 2/1981 Deigmuller
4,291,609 A * 9/1981 Iivarinen ..... F42B 33/001 86/1.1
4,455,914 A * 6/1984 Christmann ..... F42B 33/025 102/476
4,632,009 A * 12/1986 Dann ..... F42B 33/02 222/161
4,651,618 A 3/1987 Ringel
4,710,329 A * 12/1987 Lebas ..... B29C 43/10 102/292
4,920,079 A 4/1990 Kaeser
5,115,707 A 5/1992 Kutzli
5,227,576 A 7/1993 Howard
5,251,530 A 10/1993 Kaeser
5,354,519 A 10/1994 Kaeser
5,619,073 A * 4/1997 Posey ..... C06B 21/00 102/288
8,950,333 B2 * 2/2015 Burczynski ..... F42B 33/00 102/507
9,086,261 B2 * 7/2015 Harvey ..... F42B 33/00
9,546,856 B1 * 1/2017 Centrella ..... F42B 33/0207
2010/0180757 A1 * 7/2010 Park ..... F42B 33/025 86/23
2010/0229751 A1 9/2010 Dave
2010/0269723 A1 10/2010 Hugus
2011/0204094 A1 * 8/2011 Meckstroth ..... B65B 1/08 141/12
2013/0186261 A1 * 7/2013 May ..... F42B 33/00 86/1.1
2014/0020590 A1 1/2014 Torsten
2020/0300592 A1 * 9/2020 Overton ..... F42B 33/02

* cited by examiner

PRESS LOAD PROCESS FOR WARHEADS

CROSS-REFERENCE TO RELATED APPLICATIONS

This application claims the benefit under 35 USC § 119(e) of U.S. provisional patent application 62/898,068 filed on Sep. 10, 2019.

STATEMENT OF GOVERNMENT INTEREST

The inventions described herein may be manufactured, used and licensed by or for the United States Government.

FIELD OF THE INVENTION

The invention relates in general to manufacturing and in particular to warhead manufacturing.

BACKGROUND OF THE INVENTION

During manufacture of warheads, explosive fill is press loaded into the warhead casing. However, for certain warheads, this may present issues due to the geometry of the warhead casing or the material properties of the explosive fill.

For warheads with a large length to diameter ratio, quality and performance issues arise due to an inherent inefficiency in pressing long charges of powder. It is known that friction forces, both inter-particle and wall-boundary, are quality factors that must be minimized during the press-loading process. Otherwise, the pressed charges will have a density gradient marked by significant degradation along its central axis and further from the press punch. Consequently, long powder charges cannot be pressed to meet density and mass specifications.

In a conventional press-loading process, multiple increments of powder are introduced into the casing individually and then compacted to reduce the length of the powder to a manageable length. The case is fixed into a nest with a steel die or funnel attached to the case opening. Powder is poured into this funnel and then a punch driven into the funnel consolidates the powder to the desired density. Due to friction and flow inefficiency along the wall of the case and funnel, consolidation pressure within the powder drops significantly with distance from the punch. For a cylindrical punch, explosive powders are not reliably consolidated at a distance of greater than one punch diameter from the punch face. For this reason, the case is typically filled in multiple steps. A small amount of powder is consolidated, the punch is withdrawn and the load process is repeated until the case is full.

There are significant downsides to this approach. Inefficient cohesion between subsequent compacted layers and sharp corners left behind upon withdrawal of the punch may cause the layers to crack and de-laminate internally. Poorly bonded layers and low-density areas manifest themselves as transverse cracks and internal voids. When a warhead is launched, the case is propelled forward and the energetic fill is forced against the back of the case under its own momentum. This phase, referred to as setback acceleration, harbors severe risk of unintended initiation as any transverse cracks in the energetic material may close violently. Conversely, with particularly insensitive compositions, a warhead may not reliably initiate if a detonation wave cannot cross these large transverse voids.

In addition, due to the repeated consolidations, this process is time intensive. This is especially true in processes which require an evacuation of the funnel after each fill step. Generally, the use of fewer increments reduces the total cycle time but decreases the overall quality. A balanced process can be achieved, but throughput in a production setting is always choked by incremental press-loading.

Commonly owned U.S. Pat. No. 9,546,856, the entire contents of which are hereby incorporated by reference, describes a method for filling a projectile case by first isostatically pressing a column of explosive powder to create a pre-formed billet. The pre-formed billet is then placed in the case and pressed to the desired density. The single pre-formed billet effectively fills projectile cases having a large length to diameter ratio and eliminates the problems and poor quality associated with pressing multiple increments in a projectile case.

While the use of isostatically pressed pre-formed billets eliminated some of the issues with a conventional incremental press process, there are limitations to adapting the process to a robust high rate production process. First, the geometry of the pre-formed billet did not allow for complete fill during consolidation. Second, the final consolidation punch is limited in length to prevent column buckling which would cause the punch to bend and collide with the load funnel wall. Finally, certain explosive powders have significant variation in bulk powder density which presents issues during isostatic pressing.

A need exists for an improved isostatic press process which overcomes the issues described above.

SUMMARY OF INVENTION

One aspect of the invention is a method of filling a projectile case with energetic material. The method includes providing the energetic material in a powder form. A column of the powder is isostatically pressed in a mold to create a pre-formed billet (PFB). During the step of isostatically pressing the column to create a pre-formed billet, the mold is simultaneously subjected to a high frequency low amplitude periodic force and a low frequency high amplitude periodic force. The PFB is placed in the projectile case and pressed in the projectile case. The projectile case is filled using only one PFB.

The method may include employing a fill rate that is constant throughout the fill step and completely fills the mold by the time the required powder mass has been dispensed.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A method of loading energetic material in a warhead enables filling a projectile having a large length to diameter ratio with only a single increment of energetic material, while maintaining high quality. The method may be used to compact powders into long, closed containers, such as the warhead of a rocket or projectile.

The process relies on the use of pre-formed billets (PFBs) produced by isostatic pressing. Isostatic pressing is a technique that uses hydraulic fluid contained within a pressure vessel to generate uniform forces on a powder-filled flexible mold. The method overcomes issues with previous methods using PFBs produced by isostatic pressing. Namely, the improved process allows for the use certain explosive powders which have significant variation in bulk powder density which previously presented issues during isostatic pressing.

The improved process provides high density PFBs that meet the dimensional limitations require of the case load tooling. There are no gaps due to the incremental pressing of conventional approaches. Further the improved process does not rely on additional steps such as machining between isostatic consolidation, sieving before isostatic pressing or reworking of powder. Nor does it waste powder. The process can handle a wider variety of bulk densities than prior isostatic processes, so the careful blending of powder to maintain a very tight bulk density range is not required. PFB weight is tightly controlled, minimizing post-processing steps to remove excess material from the warhead and eliminating the possibility of an under-filled warhead. The improved fill method minimizes the likelihood that the top or bottom of the mold would be packed more tightly than other sections thus preventing any bulged sections from forming in the pressed billet. Finally, the improved process results in a higher density than pressing with conventional powder pressing or stacked pellets and press cycle time is greatly reduced.

Figure 1:
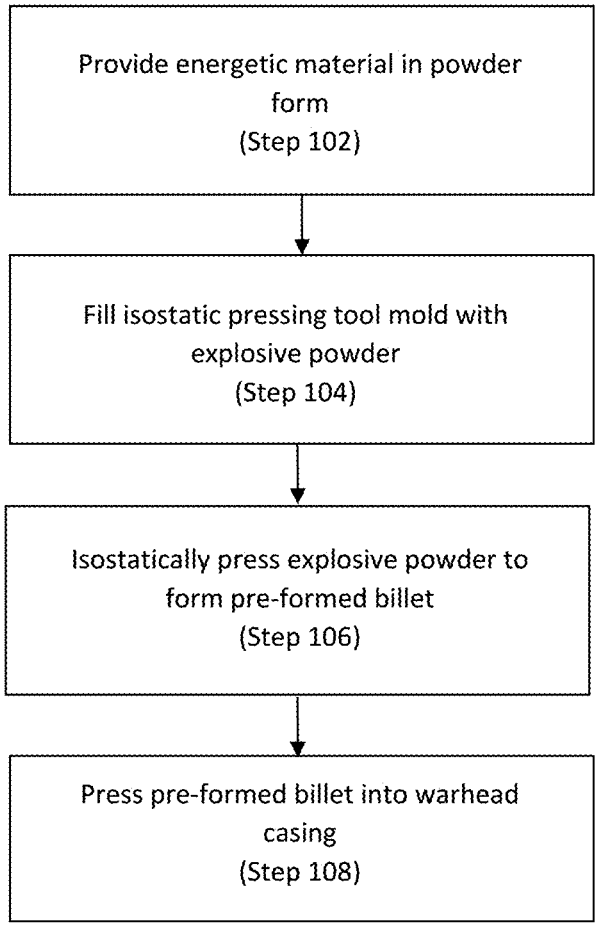
FIG. 1 is a flowchart illustrating a method of filling a projectile case with energetic material, according to an illustrative embodiment.

FIG. 1 is a flowchart illustrating a method of filling a projectile case with energetic material, according to an illustrative embodiment.

In step 102, the energetic material is provided in powder form. Advantageously, due to the advantages of the method, the energetic material may be an energetic material which has significant variation in bulk powder density. In one embodiment, the bulk powder density may vary by plus or minus 5% from the median density. For example, the bulk powder density may vary from 0.79 to 0.86 grams per cubic centimeter (g/cc).

In step 104, a mold 210 is filled with the explosive powder at a constant feed rate while the mold 210 is simultaneously subjected to high frequency low amplitude vibrations and low frequency high amplitude impulses. First, a polyurethane mold 210 is filled with the powder which is to be pressed.

Figure 2:
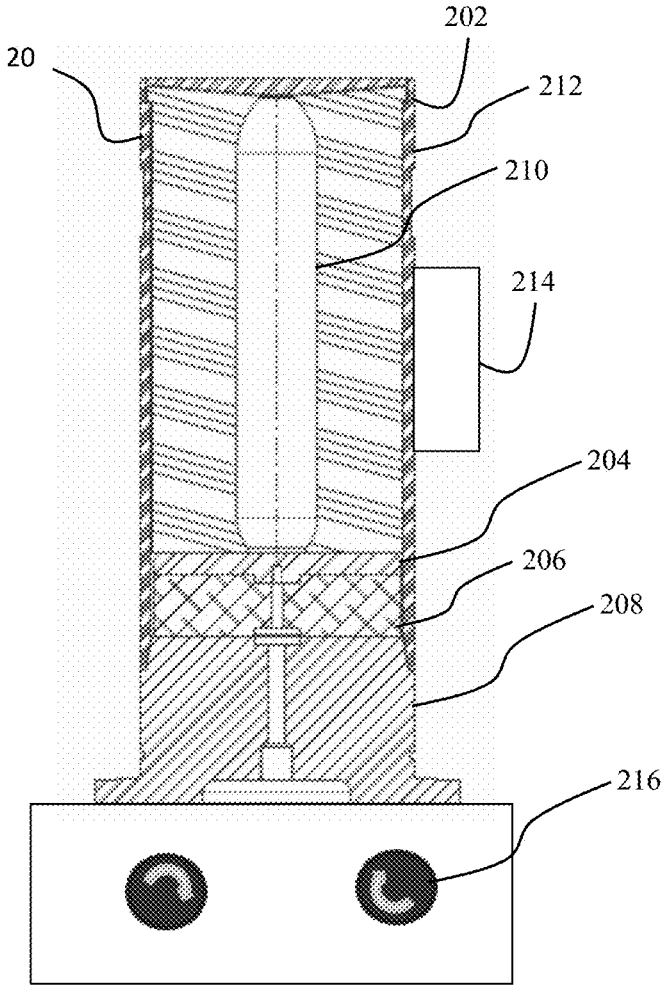
FIG. 2 is a cross-sectional view of an isostatic pressing tool, according to an illustrative embodiment.

FIG. 2 is a cross-sectional view of an isostatic pressing tool, according to an illustrative embodiment. The isostatic pressing tool 20 includes a fixed lid 202 and a base plate 204. A spacer 206 and a pressure plug 208 are disposed beneath base plate 204. The powder column is disposed in bag tooling, for example, a low durometer polyurethane mold 210. The interior walls of the pressure vessel (not shown) are an oil-filled bladder which applies force to the mold 210 without exposing the mold 210 to the oil. Isolating the oil from the mold 210 simplifies loading and extraction of the mold 210 and enables easier automation of the isostatic pressing process.

The isostatic pressing tool 2 further comprises one or more vibration motors 216 and an impulse generator 214. The combination of the two force generators ensures that certain explosive powders, such as polymer bonded explosive powders, pack to consistent densities. The vibration motors 216 may be electric rotary eccentric-mass vibration motors. The vibration motor 216 is disposed below the low pressure plug 208 and provide a constant low amplitude high frequency vibration to the isostatic pressing tool 2 to increase the powder density. The one or more vibration motors 216 allow for an adjustable amplitude and frequency to accommodate various production variables and desired products. In one embodiment, the high frequency vibration motors 216 are set in the range of approximately 100 Hz to 900 Hz.

The impulse generator 214 provides a low frequency high amplitude impulse to the outer sleeve 212 of the isostatic pressing tool 2 to further increase the powder density. In one embodiment, the impulse generator 214 is a slapper or piston vibrator device. In one embodiment, the impulse generator 214 provides an impulse in the range of 2-3 Hertz (Hz).

Figure 3:
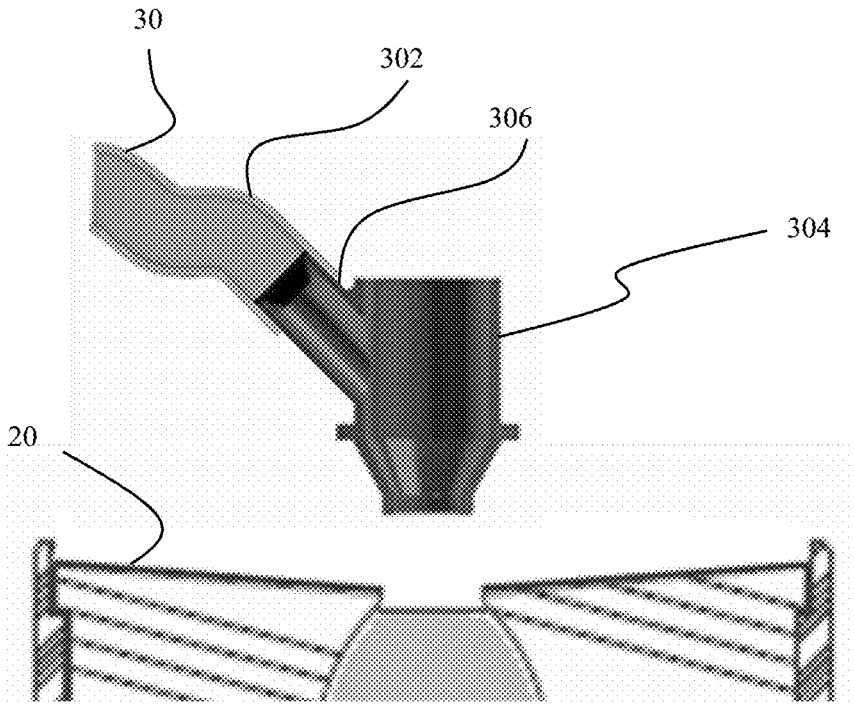
FIG. 3 is a cross-sectional view of an isostatic pressing tool and a fill assembly, according to an illustrative embodiment.

FIG. 3 is a cross-sectional view of an isostatic pressing tool 2 and a fill assembly, according to an illustrative embodiment. The explosive powder is filled into the mold 210 via a fill assembly 30. The fill assembly 30 further comprises a fill hose 302, a nozzle 304 and a flow control device 306 at the interface of the fill hose 302 and the nozzle 304. The fill hose 302 provides the explosive powder to the nozzle 304. The bottom of the nozzle 304 interfaces with corresponding features on the mold 210.

The flow control device 306 is positioned at the interface between the fill hose 302 and the nozzle 304 to control the flow rate of the explosive powder from the fill hose 302 to the nozzle 304. The flow control device 306 may be an orifice or valve.

Over-filling the mold 210 and applying vibration impulse to reduce the powder stack volume is not acceptable as it results in unacceptable PFB. Accordingly, the process requires that for additional vibration to properly pack the isostatic mold 210, the powder flow rate is reduced at the flow control device 306 or nozzle 304 and the material flows freely throughout the fill procedure.

Due to the concerns noted above, the flow control device 306 is configured such that the time required to fill the mold 210 is equal to the time required to dispense the explosive powder. This is unlike other isostatic mold fill procedures. The polymer binders of pressed explosive compositions require that powder be constantly flowing to reduce the risk of powder clogs. Additionally, the powder reactivity requires that opening/closing valves must be designed not to pinch explosive material, both to eliminate clogs and reduce the risk of accidental explosion.

In step 106, the explosive powder is isostatically pressed to create the PFB. To isostatically press the column of the energetic material to create the PFB, the explosive powder is provided from the fill hose to the mold 210 via the nozzle at a constant rate throughout the entire fill process and such that the mold 210 is completely filled by the time the required mass has been dispensed but not excessively packed such that it is below a fill tolerance when fully dispensed. The fill tolerance is dependent on the needs of the particular warhead. During the fill process, the mold 210 is subjected to both high frequency low amplitude vibrations and low frequency high amplitude impulses.

Isostatic pressure is applied to the mold 210 by hydraulic fluid. As the hydraulic fluid pressure increases, the mold 210 transfers the pressure to the powder column. The isostatic pressing process reduces the diameter of the powder column while the length of the column is unchanged. Base plate 204 and lid 202 are fixed in place to constrain axial flow of the powder in column.

The finished PFB is fairly straight along its central axis, and has a rough finish. The mold 210, base plate 204 and lid 202 can be designed to form a variety of shapes and features needed for press loading. The shapes and features may include, for example, ogives, domes, shoulders, bellies, etc.

In the isostatic pressing process, the pressure, temperature, vacuum level and dwell time may be controlled parameters. Pressing the PFB isostatically may require known tooling made of polyurethane and metal. Because the PFB is isostatically pressed on its radius, there are no density gradients along the central longitudinal axis (along the length). PFBs of almost any lid ratio can be isostatically pressed without degrading the density consistency needed for warheads.

In step 108, the PFB is pressed into a warhead casing. Once a PFB has been isostatically pressed, it can be immediately loaded into a waiting projectile case for final press-loading or, it can be moved into raw material inventory for future press loading. Either way, the PFB is the single increment charge necessary to implement the remainder of the warhead loading process.

After the PFB is isostatically pressed, conventional press tooling and platforms may be used to deform the PFB inside a projectile case. Depending on the projectile case strength, the mechanical properties of the energetic material, and the pressing parameters, the press tooling can be designed to meet safety regulations and quality standards. In addition to the pressing parameters controlled in the isostatic pressing process, ram position may also be controlled when pressing the PFB in the projectile case.

Well-characterized energetic material properties provide a reliable basis for developing mathematical models for predicting behavior of the column of energetic material under consolidation stress. Stress fields and density mapping shown through finite element analysis (FFA) can provide insights to tooling design and press process development (time, temperature, pressure). The PFB will deform under relatively low force. To fill corners of a projectile case with energetic material and to raise the fill-density to near theoretical maximums, greater pressing forces may be required.

Prior to pressing the PFB into an empty projectile case, the projectile case is aligned and supported by tooling so that the projectile case remains fully constrained during the pressing step. The PFB may be pressed to a density of, for example, about 95% of the theoretical maximum density so that the energetic material readily deforms and flows in the projectile case void. Once the energetic material begins to flow and fills the void, its density begins to rise as the pressure increases. The deformation of the PFB within the consolidation zone in the projectile case is radially outward toward the case wall. The radially outward deformation minimizes wall friction and counter forces applied to the advancing press punch.

In one embodiment, the PFB is pressed into the case via a conventional press. The press may include a ram, a forming punch, a support die, a support tooling and a loading sleeve. Support tooling provides alignment and support of the projectile case under extreme loading forces. Forming tools such as forming punch may be useful to produce desired features in the pressed charge.

While the invention has been described with reference to certain embodiments, numerous changes, alterations and modifications to the described embodiments are possible without departing from the spirit and scope of the invention as defined in the appended claims, and equivalents thereof.

What is claimed is:

1. A method for filling a projectile case with energetic material, the method comprising the steps of: providing the energetic material in powder form; filling a mold of an isostatic pressing tool at a constant rate while simultaneously subjecting the mold to a high frequency low amplitude vibration and a low frequency high amplitude impulse; isostatically pressing a column of the powder to create a pre-formed billet; placing the pre-formed billet in the projectile case wherein the interior cavity of the projectile case has a larger maximum diameter than an opening of the projectile case; axially pressing the pre-formed billet in the projectile case thereby increasing the density of the pre-formed billet; and filling the projectile case using only the one pre-formed billet;

wherein the energetic material is filled into the mold via a fill assembly comprising a fill hose, a nozzle and a flow control device at the interface of the fill hose and the nozzle, and wherein the flow control device is configured such that the energetic material is provided from the fill hose to the mold via the nozzle at a constant rate throughout an entire fill process and such that the time required to fill the mold is equal to the time required to dispense the energetic material.

2. The method of claim 1 wherein the step of providing the energetic material in powder form further comprises providing the energetic material in powder form with variation in bulk powder density.

3. The method of claim 2 wherein the bulk powder density varies within a range of plus or minus five percent from a median density.

4. The method of claim 1 wherein the isostatic pressing tool further comprises one or more vibration motors and an impulse generator.

5. The method of claim 1 wherein the mold is subjected to a high frequency low amplitude vibration in a range of 100 Hertz to 900 Hertz.

6. The method of claim 1 wherein the isostatic pressing tool further comprises one or more slapper devices.

7. The method of claim 1 wherein the mold is subjected to a high amplitude low frequency impulse in a range of 2 Hertz to 3 Hertz.

8. The method of claim 1 wherein the flow control device is selected from the group consisting of an orifice and a valve.

* * * * *